US005163490A

United States Patent [19]

Meis

[11] Patent Number: 5,163,490

[45] Date of Patent: Nov. 17, 1992

[54] KNIFE CLAMP FOR WOOD PLANING HEADS

[75] Inventor: Thomas F. Meis, Eleva, Wis.

[73] Assignee: Jackson Lumber Harvester Company, Inc., Mondovi, Wis.

[21] Appl. No.: 785,308

[22] Filed: Oct. 30, 1991

[51] Int. Cl.[5] ..... B26D 1/12; B27G 13/04

[52] U.S. Cl. ..... 144/230; 144/117 R; 144/162 R; 407/41; 407/46; 407/49

[58] Field of Search ..... 407/5, 6, 31, 40, 41, 407/46, 48, 49, 50, 101; 144/117 R, 162 R, 172, 174, 218, 230, 241

[56] References Cited

U.S. PATENT DOCUMENTS

| | | | |
|---|---|---|---|
| 1,305,650 | 6/1919 | Heggen . | |
| 1,315,536 | 9/1919 | Usher . | |
| 3,854,511 | 12/1974 | Maier | 144/230 |
| 4,055,101 | 10/1977 | Collins . | |
| 4,194,545 | 3/1980 | Kostermeier . | |
| 4,355,673 | 10/1982 | Kostermeier . | |
| 4,658,875 | 4/1987 | Grabovac . | |

*Primary Examiner*—W. Donald Bray
*Attorney, Agent, or Firm*—Fuller, Ryan, Hohenfeldt & Kees

[57] ABSTRACT

A rotatable wood planing apparatus that includes a cylindrical planing knife body provided with a plurality of longitudinally extending, forwardly inclined, radially outwardly opening channels for holding knives. Parallel to each of the knife holding channels is an adjoining channel for holding a clamping means such as a gib for clamping said knives in the channels. The rear surfaces of the knife-holding channels and the forward surfaces of the knife-clamping channels are in planes that converge outwardly. A knife-holding clamp is provided to securely hold the knife in a desired position. The knives can accurately be fitted and secured into the clamps prior to insertion into the knife-holding channels.

Means such as bolts or screws adjacent the rear of the knife-holding channels are provided for retaining the clamp and knife combination in the channel. A gib or wedge is fitted in the clamping channel to lock the clamps and knives in place upon elevation of the gib in its channel. The gib has an angled surface for engaging the knife clamp and urging it, as the gib is raised, toward the rearward surface of the channel. The knife-holding channel has a width sufficiently greater than that of the clamp to permit pivoting of the clamp away from the retaining means for removal of the clamp-knife combination from the channel when the gib is lowered.

11 Claims, 1 Drawing Sheet

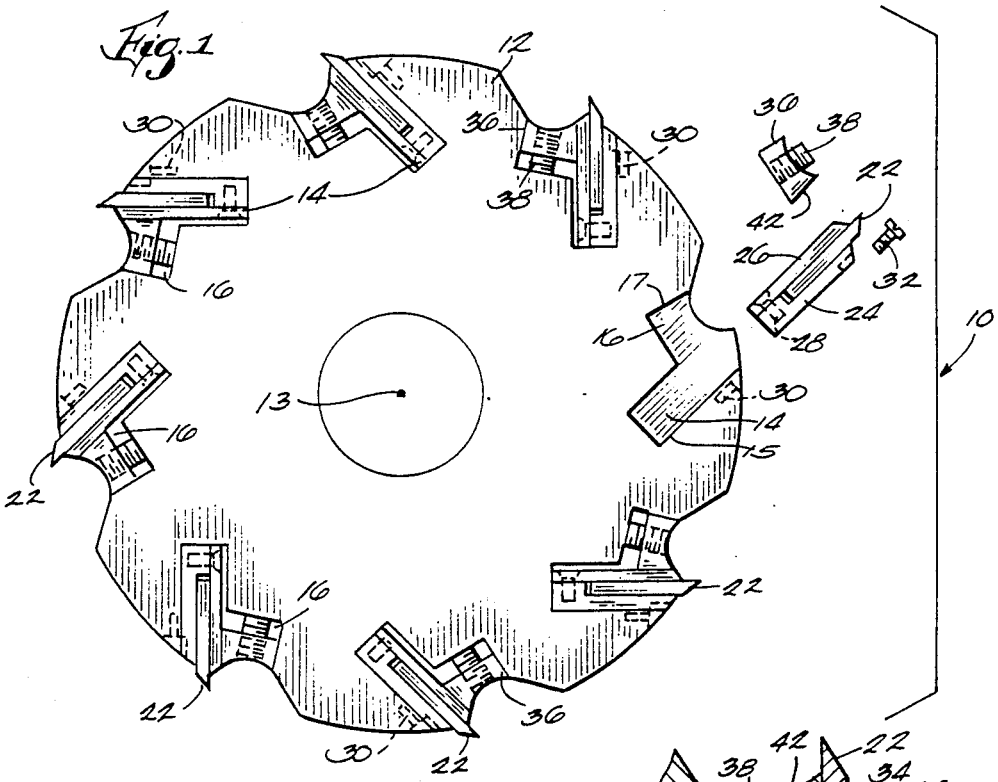
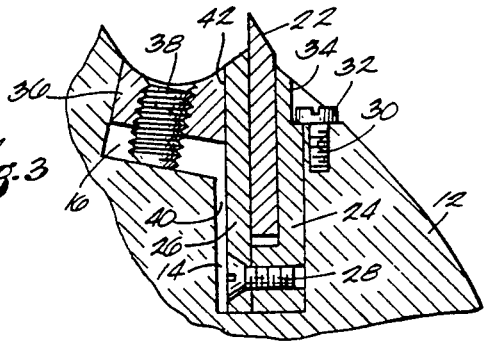
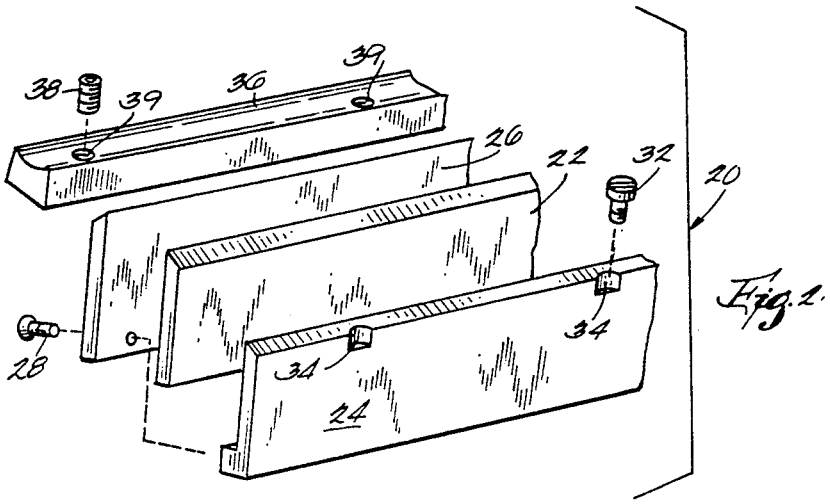
Fig. 2.

KNIFE CLAMP FOR WOOD PLANING HEADS

FIELD OF THE INVENTION

The invention relates to wood planing heads. More particularly, the invention relates to the system for clamping and securing knives in a planing head such as a rotatable wood shaving metal head.

Various holders have heretofore been devised for holding and securing knives in wood planing devices such as rotatable cylindrical planing mill devices. Typically, the knife and any holder therefore are wedged in place by means of a wedge or gib. See, for example, U.S. Pat. No. 4,658,875 issued to Grabovac on Apr. 21, 1987. In such arrangements it has generally been necessary to clamp the knife in position with a wedge using an open end wrench. Generally, the knife was set at one depth dependent on the dimensions of the knife and knife holder. Other types of holders are shown in U.S. Pat. No. 1,315,536 issued Sep. 9, 1919 and U.S. Pat. No. 4,194,545 issued Mar. 25, 1980.

A shortcoming of knife holding systems currently in use relates to the fact that in order to adjust the depth of cut or amount of knife edge exposed or extending from the cutter head, the adjustment must be done on the cutter head itself. Since a cutter head may have eight or more knives, this necessitates shutting down of the entire mill for a time sufficient to allow the necessary adjustments to be performed. Such down time is a factor in the overall cost of the planing operation being performed.

BRIEF SUMMARY OF THE INVENTION

An important object of the present invention is to provide a knife clamping and securement system which permits accurate location of the knives on a fixture, jig or workbench located away from the planing device. An important advantage and aspect of the present invention is related to the fact that the knives can be changed quickly in the machine thus saving valuable production time. A related aspect is that the present invention enables the knives to be set more accurately and uniformly because the setting of the knives in the clamps can be performed where the components are readily accessible and where special tools or jigs enabling rapid and precise location of the knives is made possible.

A further aspect of the invention is the provision of a system in which the knife clamp is tightened into its cutting position in the head while raising a gib or wedge and yet maintaining the knife-holder combination in a desired position without fear that the rising gib will force the knife outwardly too high in the channel.

Briefly summarized, the invention provides a rotatable wood planing apparatus that includes a cylindrical planing knife body. The cylindrical body is provided with a plurality of longitudinally extending, forwardly inclined, radially outwardly opening channels for holding knives around the circumference of the rotatable body. Parallel to each of the knife holding channels is a longitudinally extending adjoining channel for holding a clamping means such as a gib for clamping said knives in the channels. The rear surfaces of the knife-holding channels and the forward surfaces of the knife-clamping channels are in planes that converge outwardly. A knife-holding clamp is provided to securely hold the knife in a desired position. The knives can accurately be fitted and secured into the clamps prior to insertion into the knife-holding channels. The knife-holding clamps include plates adapted to engage the opposite sides of the knife to hold the knife therebetween and means such as a machine screw to attach the plates to each other.

Means such as bolts or screws tapped in the planing knife holding body adjacent the rear of the knife-holding channels are provided for retaining the clamp and knife combination in the channel. A gib or wedge is fitted in the clamping channel to lock the clamps and knives in place. Means such as set screws are used to provide for adjustable elevation of the gib in its channel. The gib has an angled surface for engaging the knife clamp and urging it, as the gib is raised, toward the rearward surface of the channel. The knife-holding channel has a width sufficiently greater than that of the clamp to permit pivoting of the clamp away from the retaining means for removal of the clamp-knife combination from the channel when the gib is lowered.

BRIEF DESCRIPTION OF THE DRAWINGS

The invention will be further set forth in the following detailed description and accompanying drawings wherein:

FIG. 1 is an end view of a cylindrical planing head showing the knife clamp and fastener system of the present invention with one set of knives, clamps and fasteners removed;

FIG. 2 is a perspective broken away view showing the knife, clamp, and securing gib in greater detail; and FIG. 3 is a cross-sectional end view of a portion of a planer head, knife channel and knife securing channel.

Referring more particularly to the drawings there is seen a rotatable planing mill head 12 rotatable about an axis 13. A plurality of knife holding channels 14 are located around the perimeter of head 12. Adjoining each of the knife holding channels 14 is a shallower channel 16 adapted to hold a clamping means. Numeral 10 indicates the overall combination of the planer head and knives, clamps and clamping means.

Referring to FIG. 2, numeral 20 indicates the subcombination of a knife 20 and knife clamp formed of components 24 and 26 which are secured together by means of a screw 28 to hold the knife plate 22 therebetween. Preferably the means used to attach together the plates 24 and 26 is a countersunk screw fitted into a countersunk hole in one of said plates and threaded into a tapped hole in the other of the plates.

Channels 14 and 16 extend longitudinally along the length of cylindrical planing knife body 12. It will be noted that the rear surface 15 of channel 14 and the forward surface 17 of channel 16 are located in planes which converge in a radially outward direction with respect to planer head 12.

Knives 22 can be accurately placed between the clamp halves 24 and 26 and screw 28 tightened to secure the knife in the desired position. While clamp components 24 and 26 are shown with one L-shaped component and one straight component, other variations can be substituted, for example, both sides could be L-shaped.

Threaded holes 30 are tapped into the planer head 12 immediately adjacent the rear wall 15 of each of the knife holding channels 14. Retaining screws 32 are screwed into these tapped holes. Screws 32 remain in place even when the knife and clamp combinations are removed from the head or replacement or resetting. Notches 34 are provided in a part of the knife clamp adjoining rear wall 15 in order to provide means coacting with screws 32 to hold the knife-clamp combination in place in the planing head and to prevent the same from arising therein.

A gib or wedge 36 is provided as a means to lock the knife-clamp combination in the planing head 12. Set screws 38 are provided to permit raising and lowering of gib 36 in channel 16. When gib 36 is lowered within channel 16, the knife and clamp combination can be pivoted away from screw 32 and simply lifted out of channel 14. This is due to the fact that channel 14 is wider than the thickness of the knives and clamps leaving a space 40 which allows pivoting of the clamp toward the gib and away from screw 32 for removal.

It will be noted that when the gib is raised by turning set screw 38, the fact that surfaces 15 and 17 converge enables the sloping surface 42 of the gib to urge the knife clamps 24, 26 to the right as viewed in FIG. 3 thus securely locking the clamp-knife combination in place.

It will be noted that in the case of a rotary planing device the longitudinal channels preferably are spaced around the perimeter of planer head at equally spaced intervals. Also, the forward wall of the gib-holding channel 16 in a plane perpendicular to that of the bottom of that channel, and the forward edge of the gib 36 is perpendicular to the bottom thereof. Note also that the cross-section of gib 36 is trapezoidal in shape with the rearward side being angled forwardly.

What is claimed is:

1. Rotatable wood planing apparatus comprising:

a cylindrical planing knife body having at least one longitudinal outwardly opening channel for holding a knife, said channel being forwardly inclined int he cutting direction, a parallel longitudinally extending channel adjoining said knife-holding channel for holding a means for clamping said knife in said channel, the rear surface of said knife-holding channel and the forward surfaces of said knife-clamping channels being in planes that converge outwardly, a knife held in a knife-holding clamp and fitted longitudinally in said knife-holding channel, said knife-holding clamp comprising plates engaging the opposite sides of said knife to hold said knife therebetween and means to attach said plates to each other, means on said planing knife holding body adjacent the rear of said channel for retaining said clamp and knife in said channel, a gib fitting in said clamping channel and provided with means to adjustably elevate said gib toward the outside of said channel said give having a surface for engaging said knife clamp and urging it toward the rearward surface of said channel, as said gib is raised, another surface of the gib engaging a converging surface of said channel to secure the gib, clamp and knife therein when said gib is raised, said knife-holding channel having a width sufficiently greater than that of said clamp to permit pivoting of said clamp away from said retaining means for removal of said clamp and knife from said channel when said gib is lowered.

2. Apparatus according to claim 1 wherein the forward wall of the gib holding channel is in a plane perpendicular to that of the bottom of said channel, and the forward edge of said gib is perpendicular to the bottom thereof.

3. Apparatus according to claim 2 wherein the cross-section of said gib is trapezoidal in shape with the rearward side thereof being angled forwardly.

4. Apparatus according to claim 1 wherein said clamp comprises a first flat plate and a second L-shaped plate, said means to attache said plates together comprising a countersunk screw fitted into a countersunk hole in one of said plates and threaded into a tapped hole in the other of said plates.

5. Apparatus according to claim 1 wherein said retaining means comprises a bolt threaded into a tapped hole in said body adjacent to said knife-holding channel.

6. Rotatable wood planing apparatus comprising:

a cylindrical planing knife body having a plurality of longitudinally extending, forwardly inclined, radially outwardly opening channels for holding knives, and parallel longitudinally extending channels adjoining each of said knife-holding channels for holding a means for clamping said knives in said channels, the rear surfaces of said knife-holding channels and the forward surfaces of said knife-clamping channels being in planes that converge outwardly, a knife adapted to be held in a knife-holding clamp and fitted longitudinally in said knife-holding channel, said knife-holding clamp comprising plates adapted to engage the opposite sides of said knife to hold said knife therebetween and means to attache said plates to each other, means on said planing knife holding body adjacent the rear of said channel for retaining said clamp and knife in said channel, a gib fitting in said clamping channel provided with means to adjustably elevate said gib toward the outside of said cylindrical body, said gib having a surface for engaging said knife clamp and urging it, as said gib is raised, toward the rearward surface of said channel, another surface of the gib engaging a converging surface of said channel to secure the gib, clamp and knife therein when said gib is raised, said knife-holding channel having a width sufficiently greater than that of said clamp to permit pivoting of said clamp away from said retaining means for removal of said clamp and knife from said channel when said gib is lowered.

7. Apparatus according to claim 6 wherein said longitudinal channels are spaced around the perimeter of said body at equally spaced intervals.

8. Apparatus according to claim 6 wherein the forward wall of the gib holding channel is in a plane perpendicular to that of the bottom of said channel, and the forward edge of said gib is perpendicular to the bottom thereof.

9. Apparatus according to claim 8 wherein the cross-section of said gib is trapezoidal in shape with the rearward side thereof being angled forwardly.

10. Apparatus according to claim 6 wherein said clamp comprises a first flat plate and a second L-shaped plate, said means to attache said plates together comprising a countersunk screw fitted into a countersunk hole in one of said plates and threaded into a tapped hole in the other of said plates.

11. Apparatus according to claim 6 wherein said retaining means comprises a bolt threaded into a tapped hole in said body adjacent to said knife-holding channel.

* * * * *